US008695681B2

(12) United States Patent
Daniels

(10) Patent No.: US 8,695,681 B2
(45) Date of Patent: Apr. 15, 2014

(54) SYSTEM FOR OPERATING AND POSITIONING A ROLLER SHADE

(76) Inventor: Joseph Daniels, Rosyln Heights, NY (US)

( * ) Notice: Subject to any disclaimer, the term of this patent is extended or adjusted under 35 U.S.C. 154(b) by 375 days.

(21) Appl. No.: 12/786,672

(22) Filed: May 25, 2010

(65) Prior Publication Data

US 2011/0139382 A1 Jun. 16, 2011

Related U.S. Application Data

(63) Continuation-in-part of application No. 12/635,290, filed on Dec. 10, 2009.

(51) Int. Cl.
*E06B 9/56* (2006.01)

(52) U.S. Cl.
USPC ..... 160/323.1; 160/298; 160/291; 160/308

(58) Field of Classification Search
USPC ..... 160/321, 323.1, 324, 325, 326, 903
See application file for complete search history.

(56) References Cited

U.S. PATENT DOCUMENTS

| | | | | |
|---|---|---|---|---|
| 556,255 | A * | 3/1896 | Darling | 160/256 |
| 651,611 | A | 6/1900 | Reid | |
| 1,067,708 | A | 7/1913 | Anderson et al. | |
| 1,070,042 | A | 8/1913 | Kottkay | |
| 1,238,931 | A | 9/1917 | Murray | |
| 1,356,237 | A | 10/1920 | Szefczyk | |
| 3,186,474 | A | 6/1965 | Levitas | |
| 3,220,523 | A | 11/1965 | Hepner | |
| 3,389,738 | A | 6/1968 | Roth | |
| 3,521,694 | A | 7/1970 | Anderson | |
| 3,580,323 | A | 5/1971 | Gossling et al. | |
| 4,006,770 | A | 2/1977 | Ferguson | |
| 4,223,714 | A | 9/1980 | Weinreich et al. | |

(Continued)

FOREIGN PATENT DOCUMENTS

| | | |
|---|---|---|
| WO | 199605400 | 2/1996 |
| WO | 0050290 | 8/2000 |

(Continued)

OTHER PUBLICATIONS

U.S. Appl. No. 12/635,290, System for Operating and Positioning a Roller Shade, filed Dec. 10, 2009, Non-Final Action mailed Nov. 8, 2011.

(Continued)

*Primary Examiner* — Katherine Mitchell
*Assistant Examiner* — Jeremy Ramsey
(74) *Attorney, Agent, or Firm* — Amster, Rothstein & Ebenstein, LLP

(57) ABSTRACT

A system for operating and positioning a roller shade may include a roller shade clutch and an idler which are mounted to a bracket for attachment to a structure. The bracket may include a mounting plate and a wall or ceiling engaging member mounted to the mounting plate. The roller shade clutch or idler may be releasably coupled to attachment member of the bracket by a locking device. The locking device may comprise an insert having a body portion, a first end that is configured to be secured within a recess formed in a rear facing surface of the clutch, and a second end that is configured to remain extending at least partially beyond the rear surface of the clutch and to be secured by engagement with a slot formed in the bracket.

7 Claims, 19 Drawing Sheets

(56) References Cited

U.S. PATENT DOCUMENTS

| | | | | |
|---|---|---|---|---|
| 4,323,105 | A | 4/1982 | Berman et al. | |
| 4,372,432 | A | 2/1983 | Waine et al. | |
| 4,433,765 | A | 2/1984 | Rude et al. | |
| RE31,793 | E | 1/1985 | Berman et al. | |
| 4,539,238 | A | 9/1985 | Markowitz | |
| 4,865,109 | A | 9/1989 | Sherman | |
| 5,016,701 | A | 5/1991 | Vore | |
| 5,029,629 | A * | 7/1991 | Cheng-Pei | 160/300 |
| 5,203,395 | A | 4/1993 | Koller et al. | |
| 5,375,643 | A | 12/1994 | Rude | |
| 5,505,418 | A | 4/1996 | Corcoran | |
| 5,507,374 | A | 4/1996 | Rude | |
| 5,566,741 | A | 10/1996 | Ogawara et al. | |
| 5,791,393 | A | 8/1998 | Judkins | |
| 5,881,792 | A | 3/1999 | Cheng | |
| 6,158,563 | A | 12/2000 | Welfonder et al. | |
| 6,173,825 | B1 * | 1/2001 | Liu | 192/223.4 |
| 6,196,508 | B1 | 3/2001 | Nijs | |
| 6,457,688 | B1 | 10/2002 | Welfonder | |
| 6,540,044 | B1 | 4/2003 | Bohringer et al. | |
| 6,685,592 | B2 | 2/2004 | Fraczek et al. | |
| 6,935,401 | B2 | 8/2005 | Fraczek et al. | |
| 7,051,782 | B2 | 5/2006 | Nichols, Jr. et al. | |
| 7,100,668 | B2 * | 9/2006 | Allsop | 160/321 |
| 7,240,716 | B2 | 7/2007 | Nichols, Jr. et al. | |
| D557,117 | S | 12/2007 | Cannaverde | |
| 7,380,582 | B1 | 6/2008 | Anderson et al. | |
| 7,387,150 | B2 | 6/2008 | Liu | |
| 7,677,293 | B2 * | 3/2010 | Allsopp | 160/323.1 |
| 7,836,937 | B2 | 11/2010 | Anderson et al. | |
| 2003/0085003 | A1 | 5/2003 | Cheng | |
| 2003/0178276 | A1 | 9/2003 | Fraczek et al. | |
| 2004/0003904 | A1 | 1/2004 | Fraczek et al. | |
| 2005/0011618 | A1 | 1/2005 | Kee | |
| 2005/0039866 | A1 | 2/2005 | Allsopp | |
| 2005/0087313 | A1 | 4/2005 | Nichols, Jr. et al. | |
| 2006/0137833 | A1 | 6/2006 | Nichols, Jr. et al. | |
| 2006/0272782 | A1 | 12/2006 | Nichols, Jr. et al. | |
| 2007/0007100 | A1 | 1/2007 | Allsopp | |
| 2007/0056699 | A1 * | 3/2007 | Liu | 160/321 |
| 2008/0121353 | A1 | 5/2008 | Detmer et al. | |
| 2008/0202709 | A1 | 8/2008 | Anderson et al. | |
| 2010/0219306 | A1 | 9/2010 | Detmer et al. | |
| 2011/0031343 | A1 | 2/2011 | Anderson et al. | |

FOREIGN PATENT DOCUMENTS

| | | | |
|---|---|---|---|
| WO | 03080978 | A2 | 10/2003 |
| WO | 03080981 | A2 | 10/2003 |
| WO | 2005016083 | A1 | 2/2005 |
| WO | 2005040542 | A2 | 5/2005 |

OTHER PUBLICATIONS

U.S. Appl. No. 13/098,879, Adjustable Roller Shade, filed May 2, 2011, Application Undergoing Preexam Processing.

International Search Report corresponding to International Application No. PCT/US2010/059679 mailed Apr. 26, 2011.

Written Opinion corresponding to International Application No. PCT/US2010/059679 mailed Apr. 26, 2011.

International Search Report corresponding to International Application No. PCT/US2011/037919 mailed Sep. 15, 2011.

Written Opinion corresponding to International Application No. PCT/US2011/037919 mailed Sep. 15, 2011.

U.S. Appl. No. 12/635,290, filed Dec. 10, 2009.

U.S. Appl. No. 61/331,082, filed May 4, 2010.

U.S. Appl. No. 13/098,879, filed May 2, 2011.

United States Trademark Registration No. 3,356,395, registered Dec. 18, 2007.

United States Trademark Registration No. 2,965,513, registered Jul. 12, 2005.

* cited by examiner

SYSTEM FOR OPERATING AND POSITIONING A ROLLER SHADE

CROSS-REFERENCE TO RELATED APPLICATIONS

This application is a continuation-in-part of U.S. application Ser. No. 12/635,290, filed Dec. 10, 2009, the contents of which is incorporated herein by reference.

FIELD OF THE INVENTION

The present invention generally relates to a system for operating and positioning a window shade, and further relates to a roller shade clutch, idler, and bracket for operating and positioning a roller shade.

BACKGROUND OF THE INVENTION

Many variations of spring clutch systems for operating and positioning a roller shade are known in the art. Spring clutch systems typically include a spring clutch which is secured at one end of a roller shade to control the raising and lowering of the roller shade and an idler attached to the opposite end of the shade roller which follows the rotation of the roller shade. The spring clutch and idler are typically mounted to a wall or ceiling through the use of a one of a variety of brackets that are known in the art. However, there is a need for improving conventional spring clutch systems to aid in the operation and positioning of the roller shade.

SUMMARY OF THE INVENTION

According to one embodiment, a roller shade clutch mounting assembly comprises a roller shade clutch, a bracket for mounting the roller shade clutch to a structure, and a locking device for releasably coupling the clutch to the bracket.

In at least one embodiment, the locking device comprises an insert having a body portion, a first end that is configured to be secured within a recess formed in a rear facing surface of the clutch, and a second end that is configured to remain extending at least partially beyond the rear surface of the clutch and to be secured by engagement with a slot formed in the bracket.

In at least one embodiment, an edge of the slot in the bracket is slidably engaged within a recess formed in the second end of the insert to secure the bracket to the insert.

In at least one embodiment, the second end of the insert includes first and second arms extending transversely outward from the body portion in opposite directions, the bracket being inserted into the recess formed between the underside of the first arm and the rear facing surface of the clutch.

In at least one embodiment, the first arm is longer than the second arm.

In at least one embodiment, the first arm includes one or more tabs extending transversely from the sides of the first arm.

In at least one embodiment, the centerline of the insert is off-center from the centerline of the bracket when the clutch is secured to the bracket.

In at least one embodiment, the first end of the insert includes one or more locking tabs for securing the insert within cooperating features formed in the socket of the clutch.

In at least one embodiment, the slot formed in the bracket is a cross slot including first and second slots oriented for attachment of the clutch to the bracket in positions corresponding to a side wall mount position and a top ceiling mount position.

In at least one embodiment, the first slot is oriented substantially horizontally and the second slot is oriented substantially vertically.

In at least one embodiment, the bracket includes a mounting plate and an attachment member extending from the mounting plate.

In at least one embodiment, the attachment member includes an insert projecting therefrom and the clutch contains a socket in the rear surface for receiving the insert.

In at least one embodiment, the locking device includes a slide lock disposed within a slot in one of the clutch and the bracket.

In at least one embodiment, the slide lock includes first and second pins extending from opposite sides along the axis of the slot.

In at least one embodiment, the clutch is rotatable and secured to the attachment member when the slide lock is pushed outward from the clutch.

In at least one embodiment, the clutch is prevented from rotating when the slide lock is pushed inward toward the clutch.

In at least one embodiment, the locking device includes a clip at the lower end of the attachment member that is configured to be secured to the lower end of the clutch.

In at least one embodiment, the locking device includes one or more hook-type members extending from the attachment member that is configured to be secured in a recess in the clutch.

According to one embodiment, a bracket for a roller shade comprises a mounting plate, an attachment member slidably mounted to the mounting plate, and a wall or ceiling engaging member mounted to the mounting plate.

In at least one embodiment, the attachment member is attached to a support slider seated within a slot formed in the mounting plate.

In at least one embodiment, the attachment member is rotatable between a wall mount or ceiling mount configuration.

In at least one embodiment, the attachment member is mounted to the mounting plate with a mechanical fastener, the attachment member being adjustable when the mechanical fastener is loosed and secured in place when the mechanical fastener is tightened.

In at least one embodiment, the wall or ceiling engaging member is releasably mounted to the mounting plate to be adjustable between a wall mount or ceiling mount configuration.

In at least one embodiment, the wall or ceiling engaging member is integrally formed with the mounting plate.

According to one embodiment, a roller shade clutch comprises a housing having a guard defining a cavity, a chain outlet, and a chain guard spanning the chain outlet, a post extending axially from the housing, at least one torsion spring mounted on and frictionally engaging said post, a sprocket wheel being mounted for rotation over the post and seated within the cavity, a chain guard cover disposed over at least a portion of the chain guard, and a follower cap mounted over the post that is rotatable in conjunction with the sprocket wheel.

In at least one embodiment, the chain guard cover substantially covers the guard.

In at least one embodiment, the chain guard cover substantially covers a front face of the housing.

In at least one embodiment, one side of the chain guard cover is pivotably attached to the housing.

According to one embodiment, an idler comprises an inner drum, an outer drum rotatably and slidably disposed over the inner drum, and an end cap fixed over the forward end of the outer drum.

In at least one embodiment, a compression spring is disposed axially within a cavity in the inner drum, and wherein the compression spring is in connection between the inner drum and the end cap.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying figures.

DETAILED DESCRIPTION OF THE EXEMPLARY EMBODIMENTS

Figure 1:
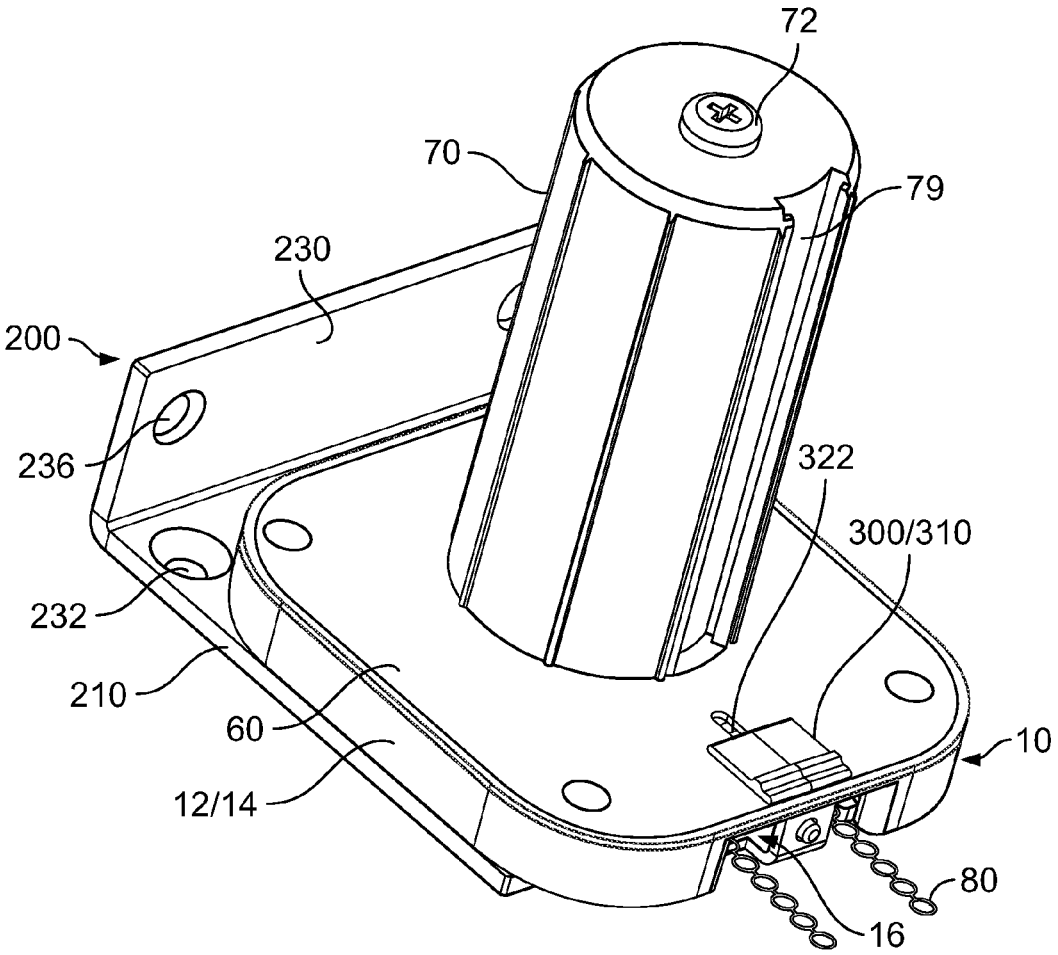
FIG. 1 is an isometric view of a roller shade clutch assembly according to an exemplary embodiment.
Figure 2:
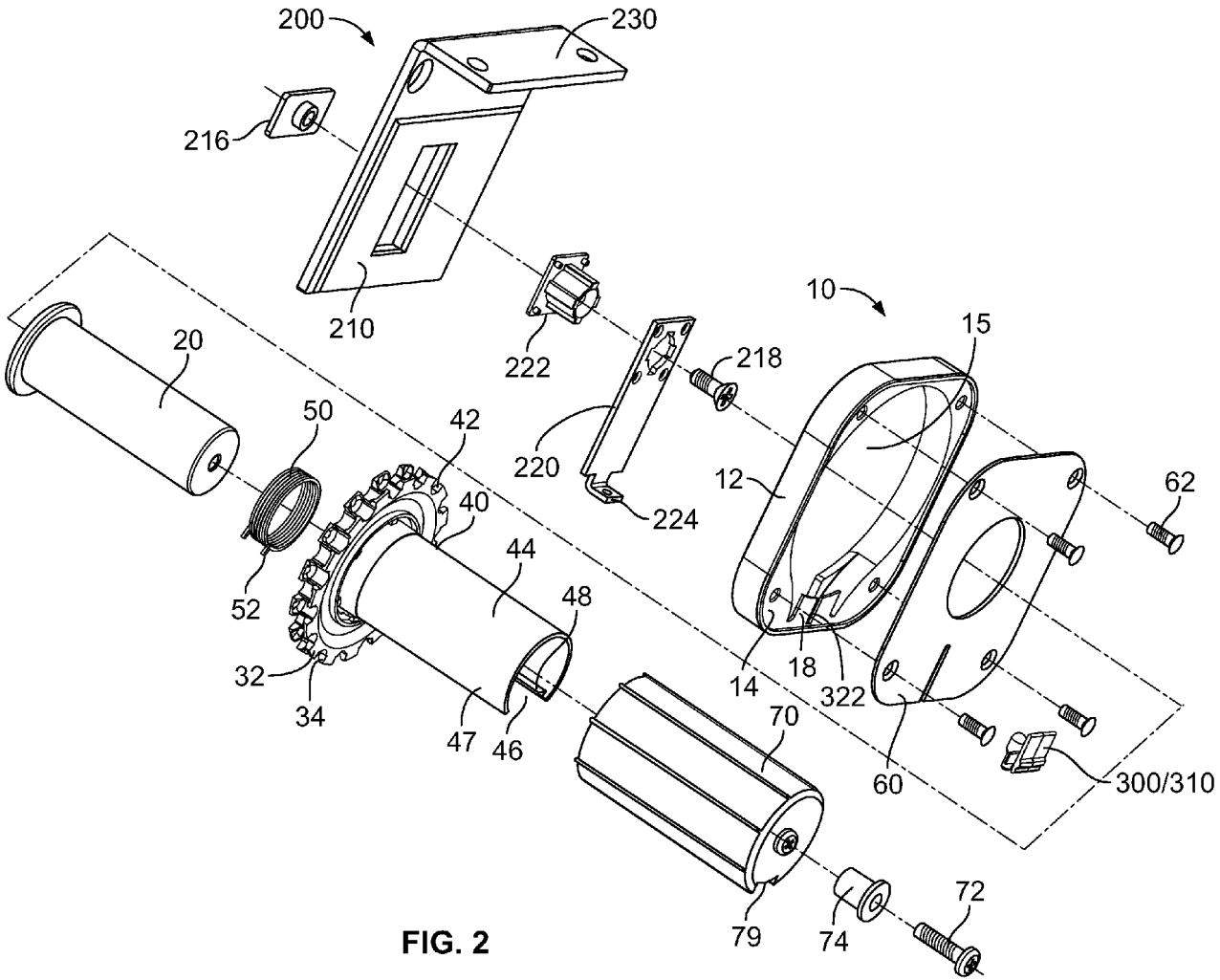
FIGS. 2-3 are exploded views of the roller shade clutch assembly of FIG. 1.
Figure 3:
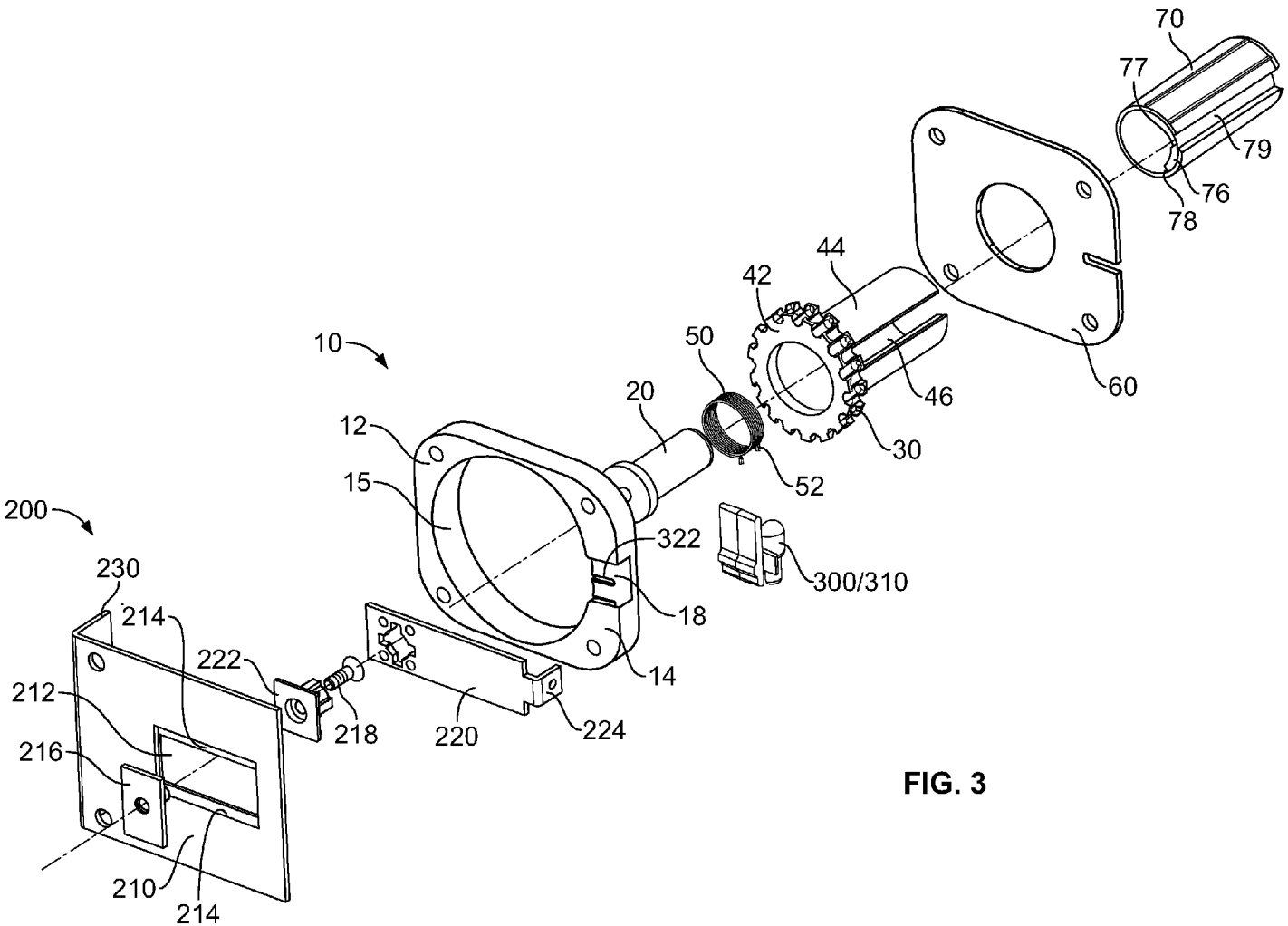
Figure 4:
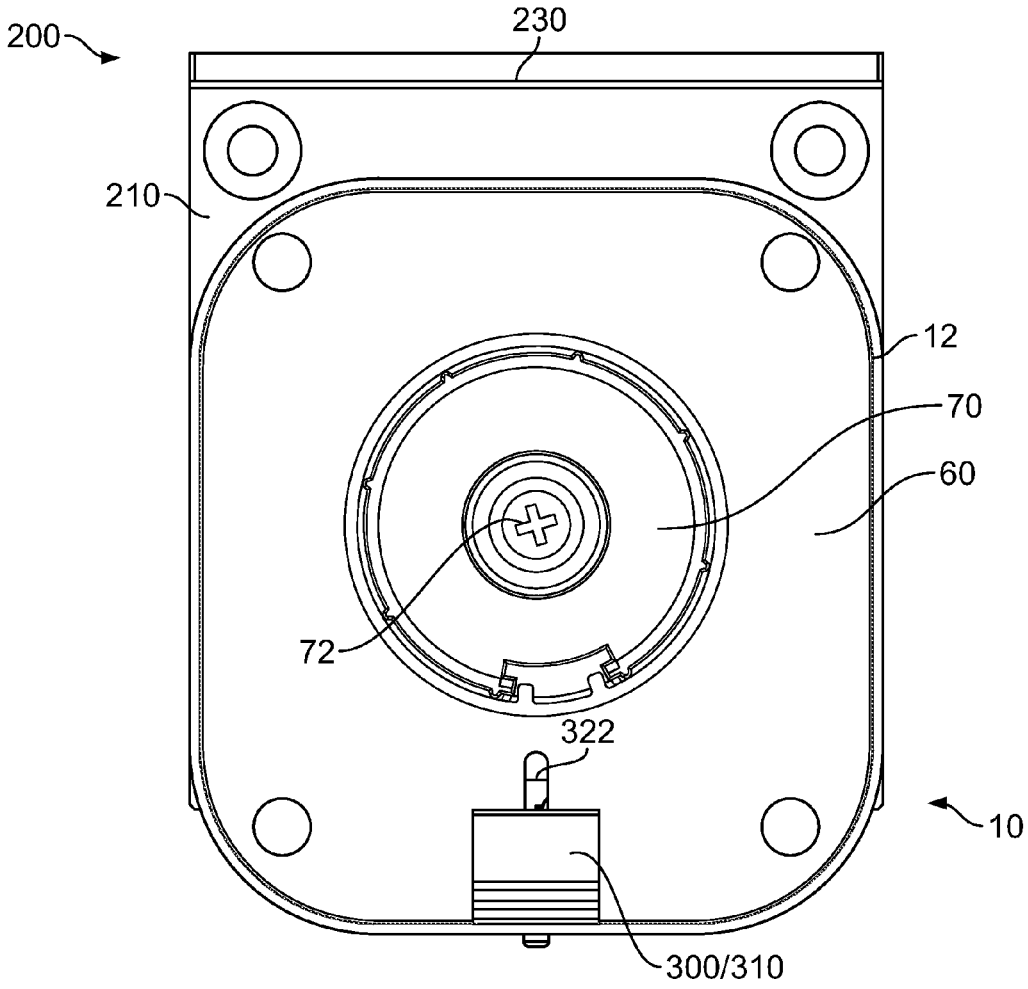
FIG. 4 is a top plan view of the roller shade clutch assembly of FIG. 1.
Figure 5:
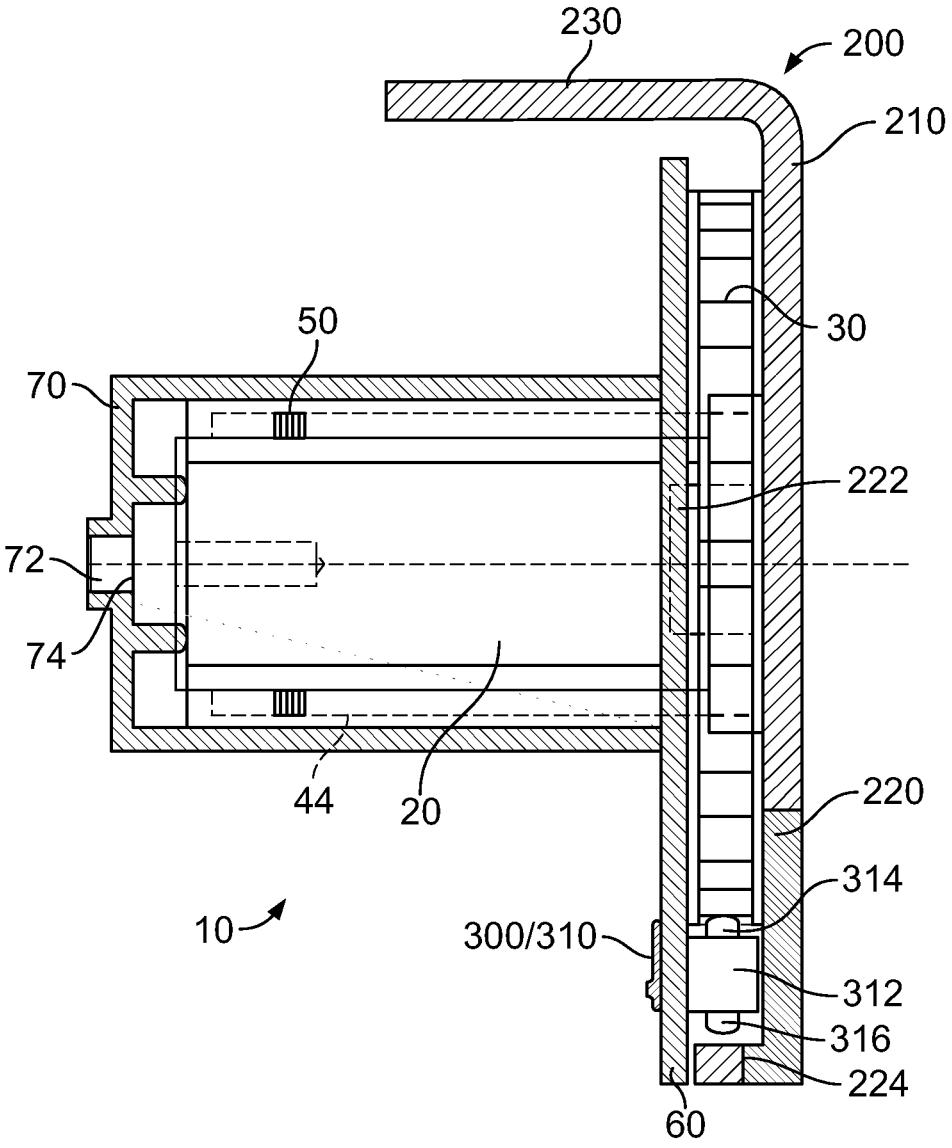
FIG. 5 is a cross sectional view of the roller shade clutch assembly of FIG. 1.

The description hereinafter describes exemplary embodiments of a roller shade system including a roller shade clutch, an idler, and a bracket in conjunction with the accompanying figures. Where possible, like numerals are used to denote like components.

The roller shade clutch and idler are adapted to be attached to a shade roller (not shown). The clutch is secured at one end of the shade roller and is used to control the raising and lowering of a window shade wrapped around the shade roller. The idler is secured to the opposite end of the shade roller and follows the rotation of the shade roller. The bracket is adapted to be coupled to the clutch and/or idler to mount the assemblies to a structure, such as a ceiling, wall, or window frame.

Referring to FIGS. 1-5, a roller shade clutch 10 according to an exemplary embodiment comprises a housing 12, a post 20 extending axially from the housing 12, a sprocket wheel 30 mounted for rotation around the post 20, at least one torsion spring 50 mounted for rotation on the post 20, an chain guard cover 60, and a follower cap 70 disposed over the post 20, torsion spring 50, and sprocket wheel 30.

The housing 12 includes a guard 14 disposed around the perimeter that defines a cavity 15 which the sprocket wheel 30 is seated. The guard 14 guides a cord or chain 80 around the sprocket wheel 30. A chain outlet 16 is formed in the guard 14 on the lower portion of the housing 12 through which the chain 80 exits. At least one chain diverter may be disposed in the chain outlet 16 to form two or more channels though which the chain 80 may pass. The section of the guard 14 spanning the chain outlet 16 is referred to as the chain guard 18.

The post 20 extends axially from the housing 12. In one embodiment, the post 20 may be formed integrally with the housing 12 such that it extends from the inner surface of housing 12 and the socket 22 may be formed in the rear surface of the housing 12. Alternatively, the post 20 may extend through a central bore formed within the housing 12. The post 20 may be comprised of metal, but the post 20 may also be formed from plastic and surrounded by a metal sleeve. A socket 22 may be formed in the rear surface of the post 20 to receive an insert 222 for attachment to the bracket 200. The connection between the socket 22 and the insert 222 may also serve to prevent the post 20 from rotating in relation to the housing 12 and bracket 200.

At least one torsion spring 50 is mounted around the post 20. The torsion spring 50 has at least one set of tangs 52 extending radially outward. The torsion spring 50 has a free inside diameter slightly smaller than the outside diameter of the post 20. In assembly, the torsion spring 50 is mounted on the post by expanding the torsion spring 50 such that it slips over the post 20. When released, the torsion spring 50 contracts on the post 20 such that the inner surface of the torsion spring 50 rests on, and forms an interference fit with, the outer surface of post 20.

The sprocket wheel 30 is mounted for rotation over the post 20 and seated within the cavity of the housing 12. The sprocket wheel 30 includes a circular hub 42 and a boss 44 extending axially from the circular hub 42. The hub 42 has an outer circumferential surface being formed with a plurality of teeth 32 separated by depressions 34. The teeth 32 and depressions 34 are constructed and arranged to entrain the chain 80. The boss 44 has an inner diameter that is larger than the diameter of post 20 so that there is an annular space between the boss 44 and the post 20 in which the torsion spring 50 is located. The boss 44 includes at least one axial slot 46 having two edges 47, 48 spaced apart by a width larger than the separation between the tangs 52 of the coils spring 50. In assembly, the tangs 52 of the torsion spring 50 are positioned within the slot 46. While the circular hub 42 and boss 44 are illustrated as forming an integral part, the circular hub 42 and boss 44 may also be formed as separate parts.

Figure 6:
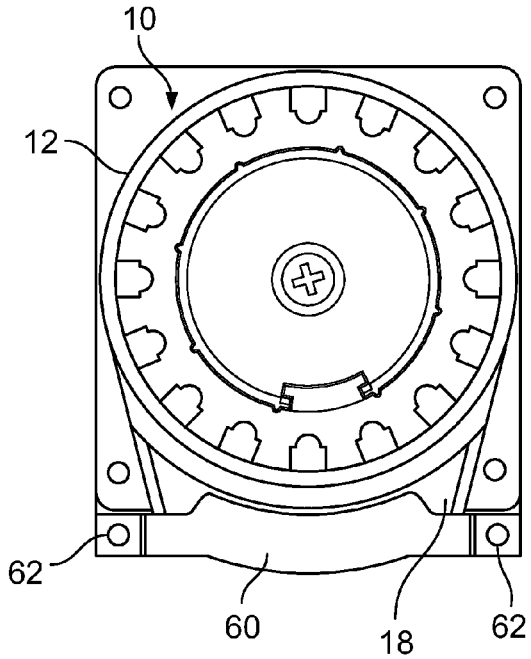
FIGS. 6-7 are top plan views of a roller shade clutch assembly according to another exemplary embodiment.
Figure 7:
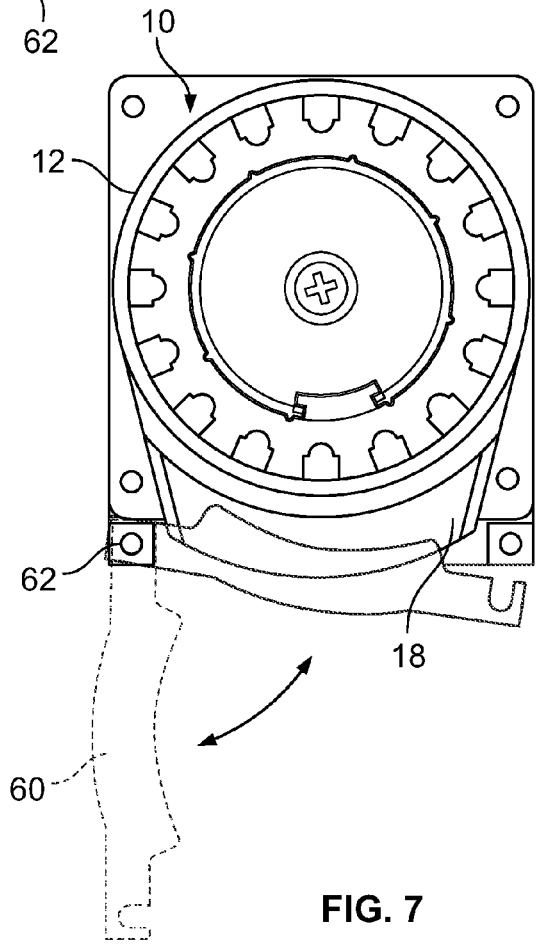

The chain guard cover 60 is mounted over the front face of the housing 12. For example, the chain guard cover 60 may cover the chain guard 18 as shown in FIGS. 6-7 or a greater area of the front face of the housing 12 (e.g., FIGS. 1-5 show the chain guard cover 60 covering substantially the entire front face of the housing 12). The chain guard 18 is a part of the clutch 10 that is susceptible to breakage when the chain 80 is pulled. For example, when the clutch 10 is mounted to a window frame, users frequently pull the chain 80 outward away from the window frame while pulling downward to operate the clutch 10. As a result, the chain 80 exerts a stress on the chain guard 18, which may cause the chain guard 18 to break. The chain guard cover 60 reinforces the chain guard 18 to prevent breakage from occurring.

The chain guard cover 60 may be secured to housing 12 by mechanical fasteners 62, such as screws, pins, rivets, or the like. Preferably, the fasteners 62 extend all the way through the housing 12 to the back of an attached bracket 200. The fasteners 62 are placed in locations that do not interfere with the path of the chain 80. For example, fasteners 62 may be disposed within the chain outlet 16 and/or outside the outer edges of the chain outlet 16. Alternatively, as shown in FIG. 6, the chain guard cover 60 may be rotatably secured to the housing 12 at one end while the opposite end of the chain guard cover 60 is configured to be releasably secured to the housing 12. This allows the chain guard cover 60 to be swiveled to be locked in place or moved out of the way as needed.

The follower cap 70 is disposed over the boss 44 of the sprocket wheel 30. The follower cap 70 includes at least one axial key 76 on its inside cylindrical surface. The key 76 has outer walls 77, 78 having a width smaller than the spacing between the tangs 52 of the torsion spring 50. In assembly, the key 76 is positioned between the tangs 52 of the torsion spring 50. The follower cap 70 is secured to the post 20 to maintain the assembly of the clutch 10, but remains rotatable to follow the rotation of the sprocket wheel 30. For example, the follower cap 70 may have an axial hole sized and shaped to receive mechanical fastening means 72, such as a screw, in conjunction with a bushing 74 for securing the follower cap 70 to the post 20. The follower cap 70 is adapted for engagement with a shade roller, such as with axial groove 79 on its outer cylindrical surface.

The clutch 10 operates as follows. The torsion spring 50 is wound such that it is biased to tighten around the stationary post 20. The friction between the inner surface of the torsion spring 50 and the outer surface of the post 20 prevents the sprocket wheel 30 from rotating around the post 20, which in turn prevents the follower cap 70 from rotating. The torsion spring 50 may be designed to have a spring force that resists a torque applied to the follower cap 70 by the weight of an attached window shade (not shown).

When the chain 80 is pulled, the rotational force applied to the torsion spring 50 by the sprocket wheel 30 uses mechanical advantage to overcome the spring force, causing the torsion spring 50 to loosen around the post 20 to allow for rotation. For example, if the chain 80 is pulled in the clockwise direction, the sprocket wheel 30 rotates in the clockwise direction. This causes one edge 48 of the slot 46 to rotate clockwise and apply a clockwise force on the outside surface of one of the tangs 52. The torsion spring 50 is wound such that the force on the tang 52 causes the torsion spring 50 to loosen around post 20. In this manner, the spring torsion spring 50 allows the sprocket wheel 30 to rotate. If the chain 80 is pulled in the counterclockwise direction, the other edge 47 of the slot 46 applies a counterclockwise force on the other tang 52, causing the torsion spring 50 to loosen around the post 50 to allow the sprocket wheel 30 to rotate. The rotation of the sprocket wheel 30 is transmitted to the follower cap 70 through the key 76 positioned between the tangs 52.

Figure 8:
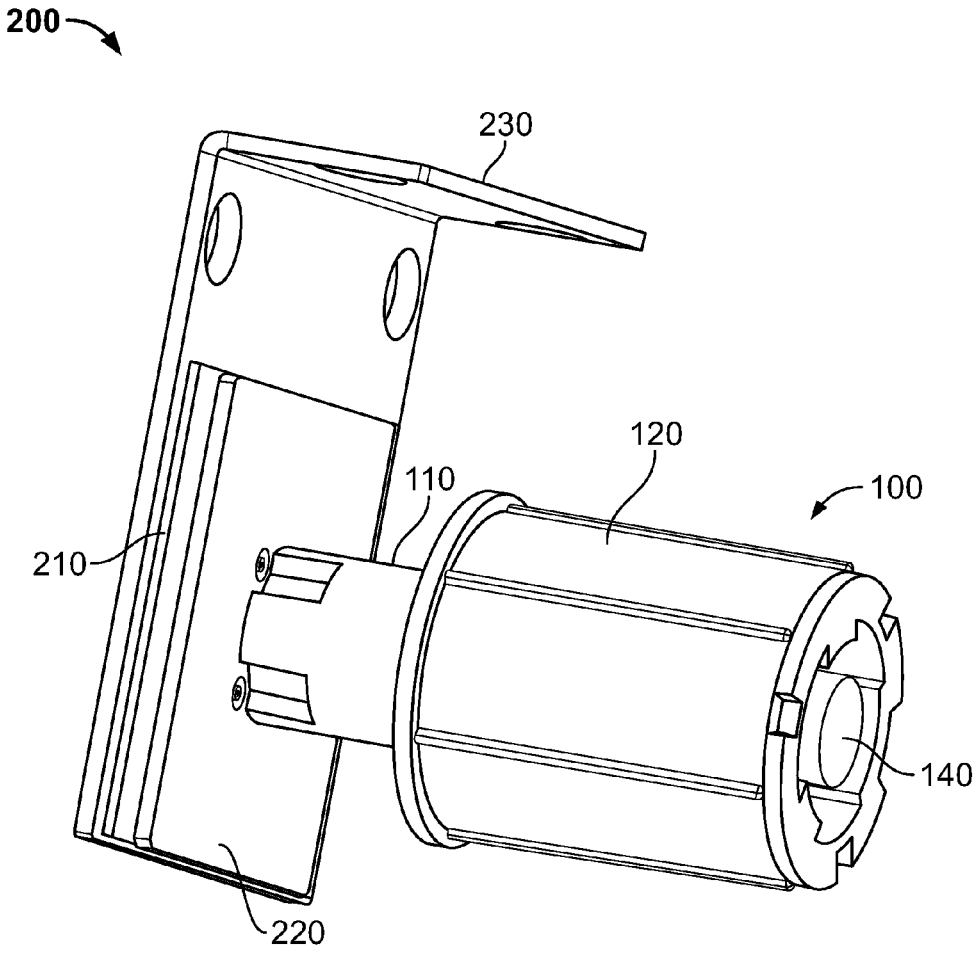
FIG. 8 is an isometric view of an idler assembly according to an exemplary embodiment.
Figure 9:
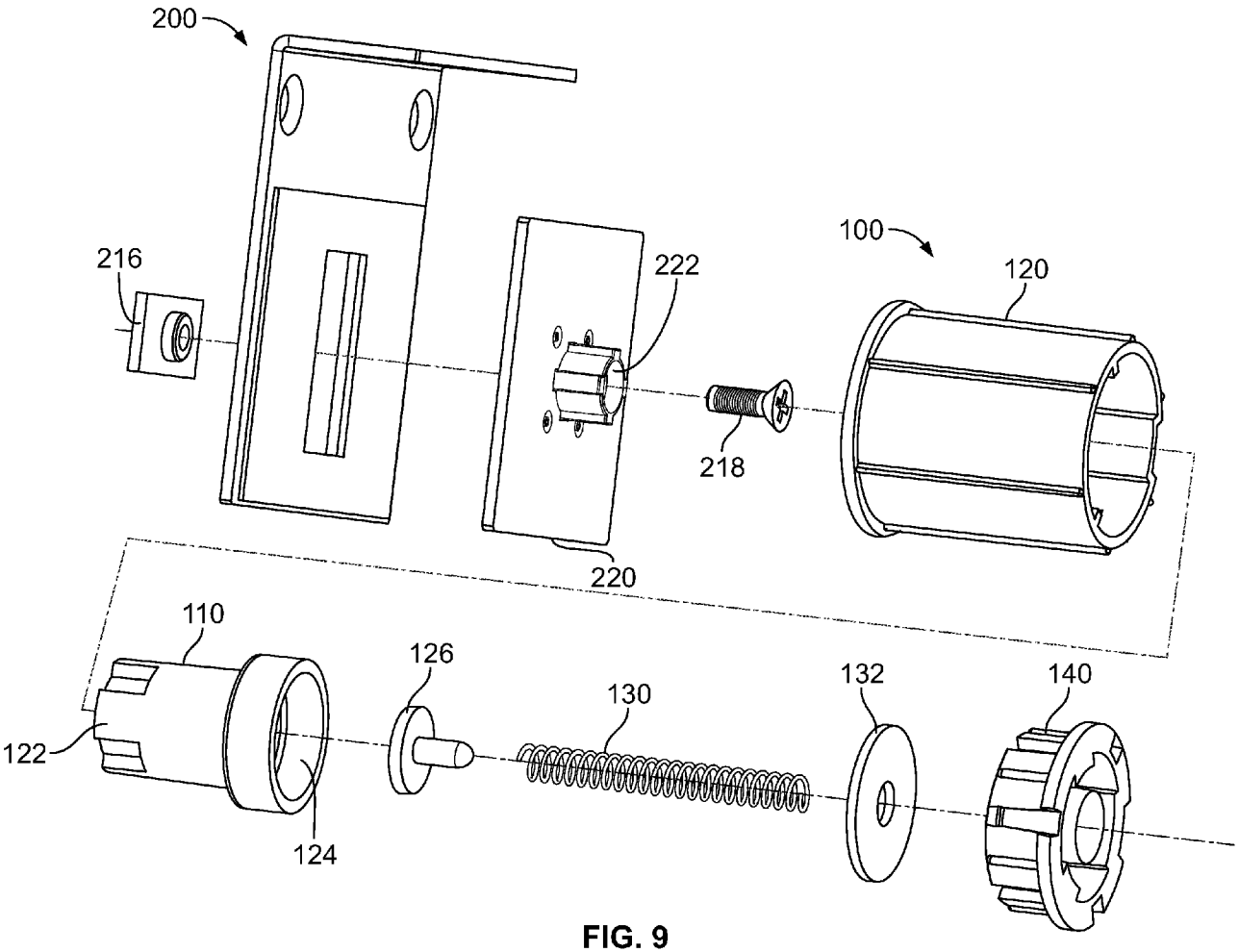
FIG. 9 is an exploded view of the idler assembly of FIG. 8.
Figure 10:
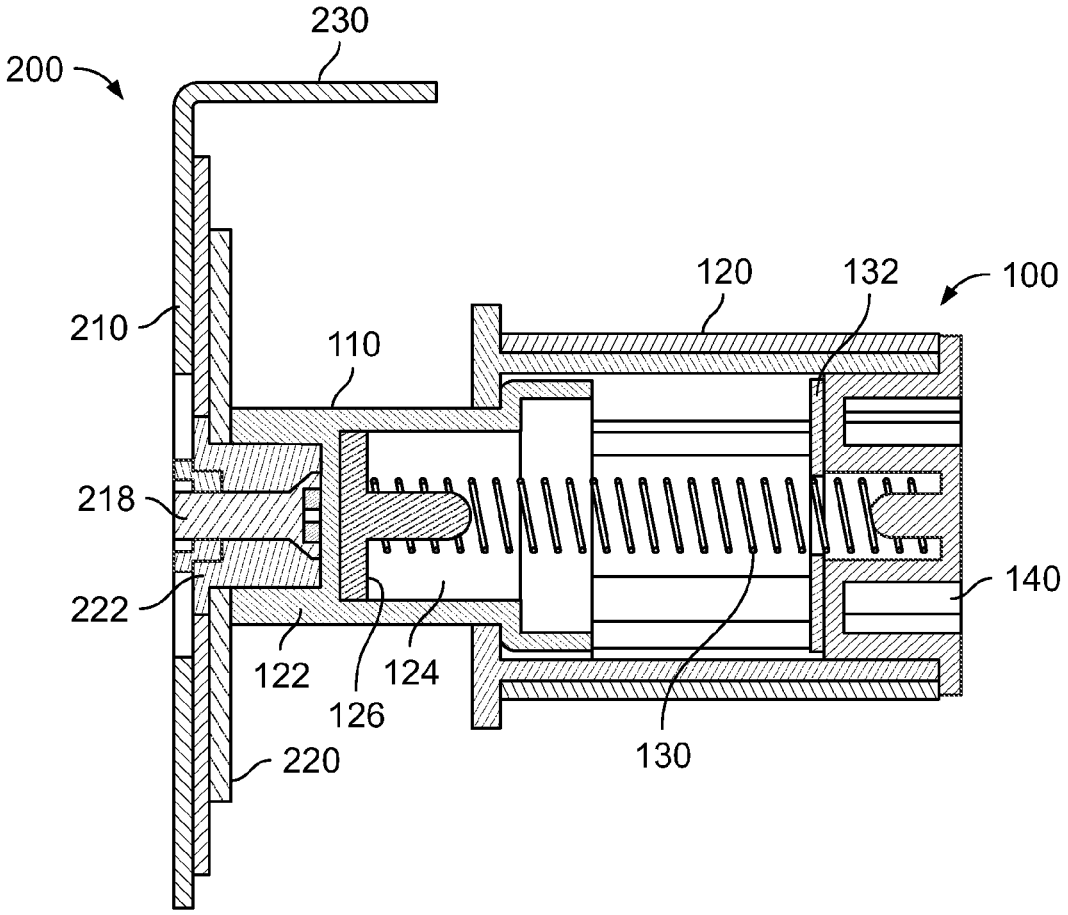
FIG. 10 is a cross sectional view of the idler assembly of FIG. 8.
Figure 11:
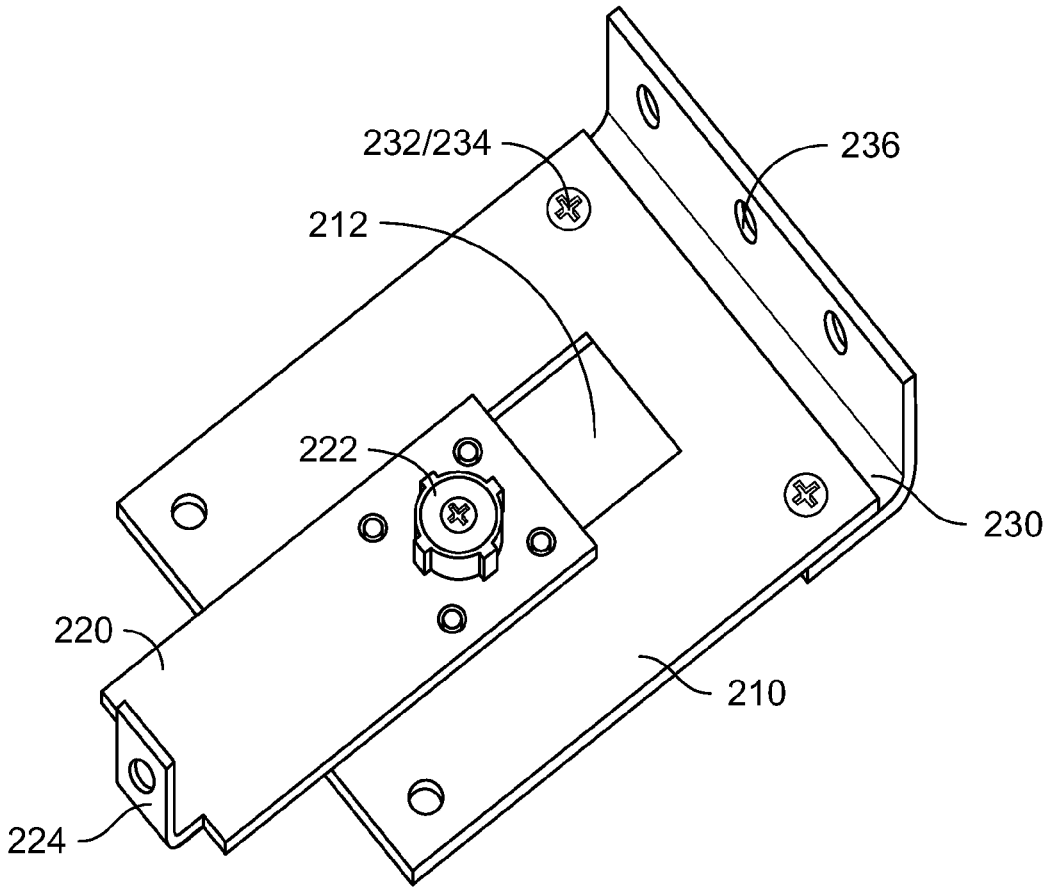
FIG. 11 is an isometric view of a bracket according to an exemplary embodiment in a top wall mount position.
Figure 12:
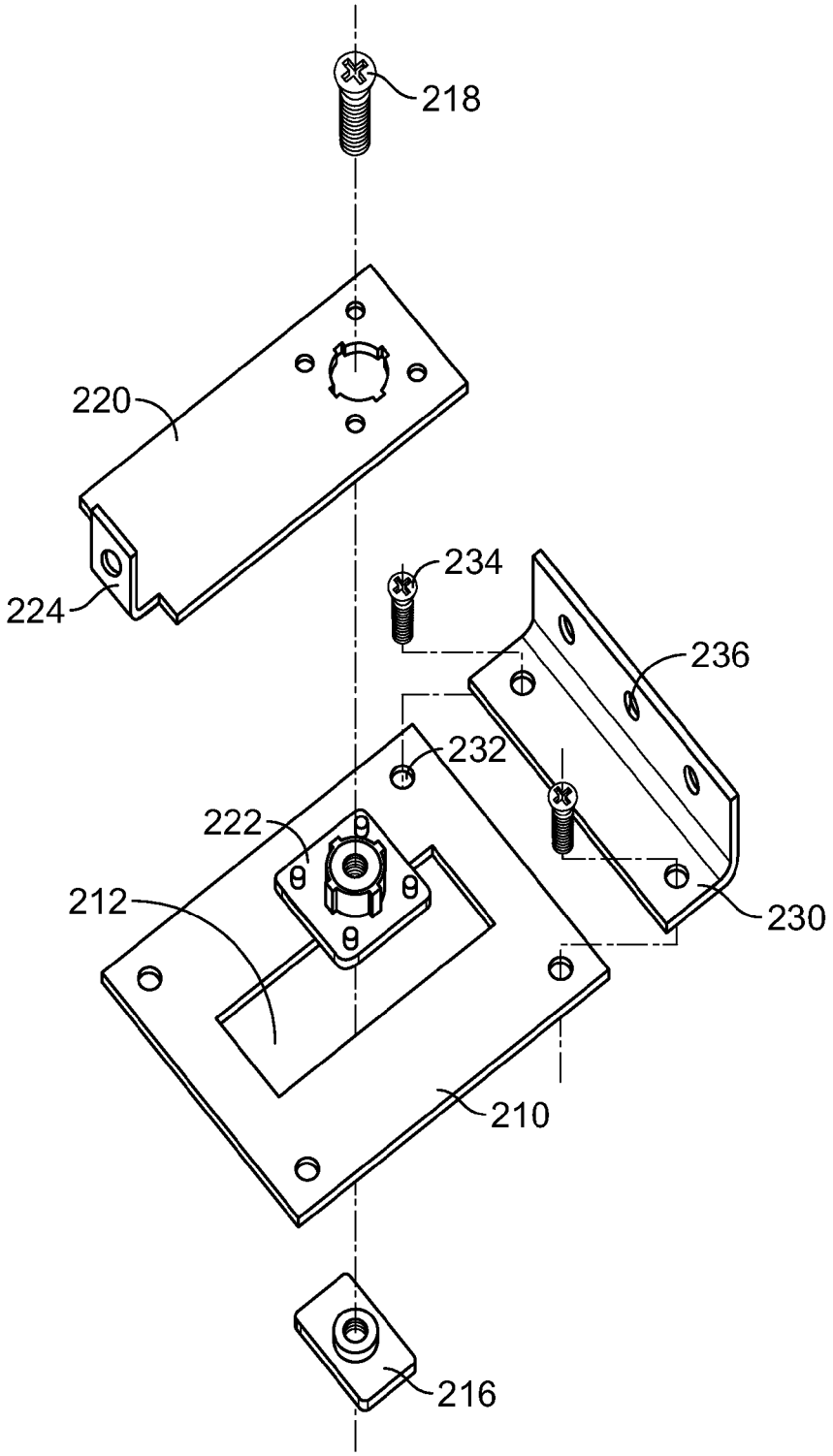
FIG. 12 is an exploded view of the bracket of FIG. 11.
Figure 13A:
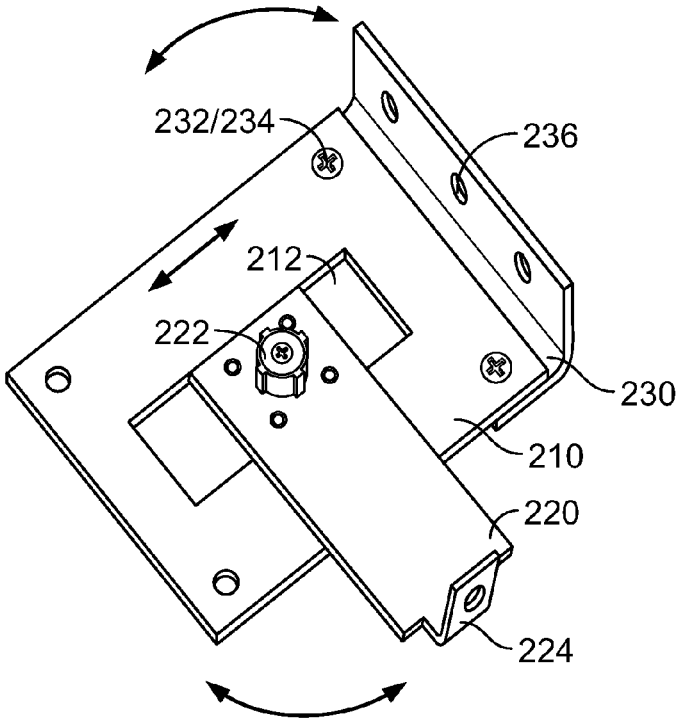
FIGS. 13A-C illustrate the bracket of FIG. 11 with the attachment member and angle bracket being adjusted between to a side wall mount position and a top ceiling mount position.
Figure 13B:
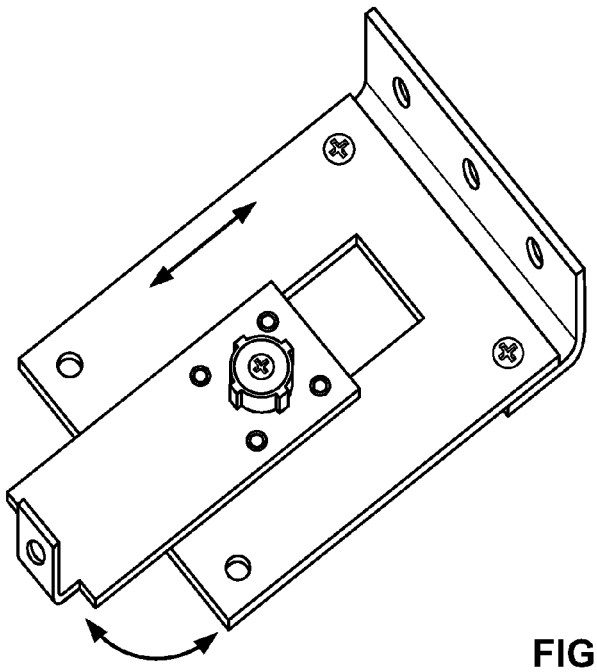
Figure 13C:
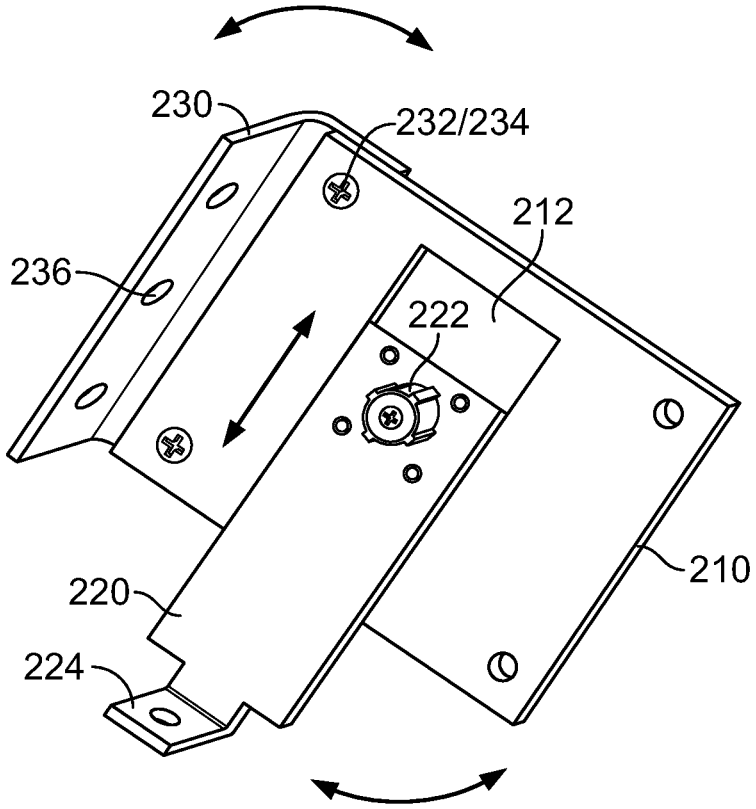

Referring to FIG. 8-10, an idler 100 according to an exemplary embodiment comprises an inner drum 110, an outer drum 120 rotatably and slidably disposed over the inner drum 110, a compression spring 130 disposed axially within the inner drum 110, and an end cap 140 fixed over the forward end of the outer drum 120 and which is adapted for engagement with a shade roller (not shown).

The inner drum 110 includes socket 122 formed in the rear end to receive an insert 222 for attachment of the bracket 200. The connection between the socket 122 and the insert 222 prevents the inner drum 110 from rotating or sliding in relation to the bracket 200. The outer drum 120 rotates freely in relation to the inner drum 110.

The inner drum 110 includes a cavity 124 formed in the forward end. A bearing 126 is seated at the bottom of the cavity 124. The compression spring 130 is disposed over the bearing 126 and is connected between the inner drum 110 and the end cap 140. The compression spring 130 controls the sliding relationship of the outer drum 120 in correlation to the inner drum 110, thereby allowing the idler 100 to be adjusted to accommodate a shade roller.

Referring to FIGS. 11-14, a bracket 200 according to an exemplary embodiment comprises a mounting plate 210, an attachment member 220 adjustably mounted to the mounting plate 210, and an angle bracket 230 adjustably mounted to the mounting plate 210. The bracket 200 is used for mounting clutch 10 or idler 100 to a structure, such as a wall or ceiling. The bracket 200 allows for adjustment of the position of the clutch 10 or idler 100 on the bracket 200 and/or for adjustment between a side wall mount position and a top ceiling mount position. While the bracket 200 can be coupled with either the clutch 10 or idler 100, the description hereinafter is described in relation only to the clutch 10.

The mounting plate 210, attachment member 220, and angle bracket 230 can be formed of any suitable plastic, metal, or other material. The mounting plate 210 can be any size, material or shape upon which the clutch 10 can be affixed.

The attachment member 220 is adjustably mounted within a slot 212 in the mounting plate 210. A support slider 216 is slidably seated in the slot 212 and attached to the attachment member 220 by a mechanical fastener 218, such as a screw. Grooves 214 may be formed adjacent opposite sides of the slot 212 on the rear face of the mounting plate 210 to maintain a flush rear surface on the mounting plate 210. When the fastener 218 is loosened, the attachment member 220 is vertically slidable along the slot 212 to allow for adjustment of the location of the clutch 10. The attachment member 220 then can also be rotated around the support slider 216 such that the attachment member 220 extends either downward or to the side. When the fastener 218 is tightened, the attachment member 220 is fixed in place.

The attachment member 220 is coupled to the clutch 10. The attachment member 220 includes an insert 222 at one end which is received in a socket 22 in the rear surface of the post 20 (or in the rear surface of the housing 12). The insert 222 is illustrated as a separate independent component, but may instead be formed integrally with the attachment member 220 or the mounting plate 210. The insert 222 may alternatively be used as the support slider 216. The opposite end of the attachment member 220 is configured to be secured to the lower end of the housing 12. For example, the attachment member 220 may be secured to the lower end of the housing 12 by a screw or through the use of a locking device 300, examples of which are described below in more detail.

The angle bracket 230 is secured to the mounting plate 210 by mechanical fasteners 234, such as screws, rivets, or the like, through holes 232. For a top ceiling mount position, the angle bracket 230 is secured along the upper edge of the mounting plate 210. For a side wall mount position, the angle bracket 230 is secured along a side edge of the mounting plate 210. Alternatively, the angle bracket 230 may be formed integrally with the mounting plate 210. The bracket 200 may be fastened to a structure, such as a wall, ceiling, or window frame, by the use mechanical fasteners which pass through openings 236 in the angle bracket 230, by an adhesive, or by other means of fastening.

FIGS. 1-5 and 14-19 illustrate various exemplary embodiments of a locking device 300 used to releasably secure a clutch 10 to a bracket 200. It is intended that the locking device can also be used to releasably secure an idler 100 to a bracket 200.

Referring to FIGS. 1-5, according to an exemplary embodiment, the locking device 300 is a slide lock 310 that is slidably disposed within a slot 322 formed in the chain guard 18 of the clutch 10. Alternatively, the slide lock 310 may be disposed in a slot formed in the attachment member 220 or mounting plate 210 of the bracket 200. The slide lock 310 includes a protrusion 312 that extends into the chain outlet 16. First and second pins 314, 316 extend from opposing sides of the protrusion along the axis of the slot 322.

When the slide lock 310 is slid upwards along the slot 322 toward the clutch 10, the first pin 314 is extended into one of the depressions 34 in the sprocket wheel 30 to prevent the sprocket wheel 30 from rotating. This indicates that the clutch 10 is not fully secured to the bracket 200. When the slide lock 310 is slid downward along the slot 322, the first pin 314 is extricated from the depression 24, while the second pin 316 is extended into a receptacle 224 projecting in the attachment member 220 of the bracket 200. This secures the clutch 10 to the bracket 200 and allows the sprocket wheel 30 to rotate, thereby making the clutch 200 operable.

Figure 14A:
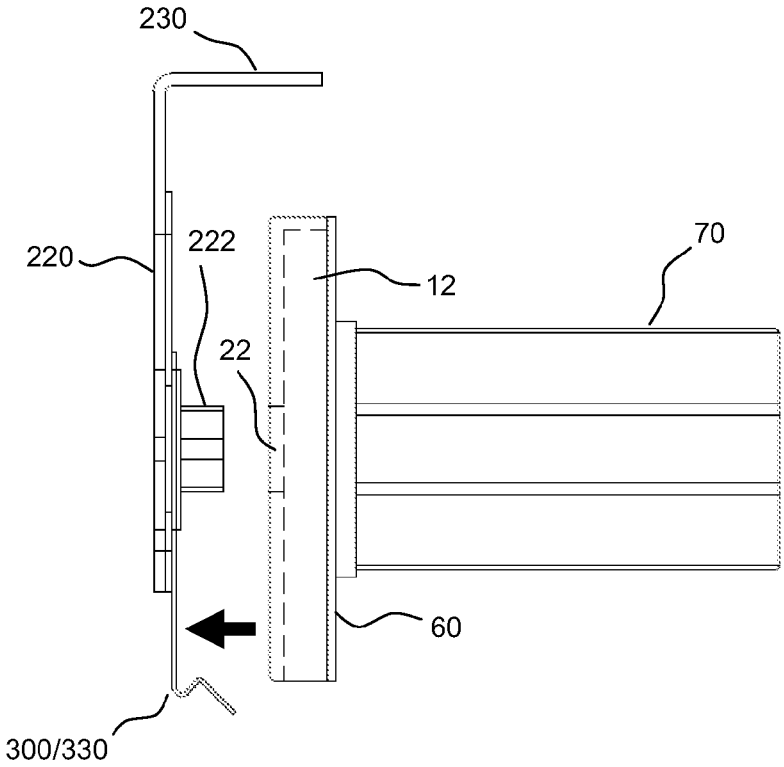
FIGS. 14A-B are a side views of a roller shade clutch assembly illustrating a locking device according to an exemplary embodiment
Figure 14B:
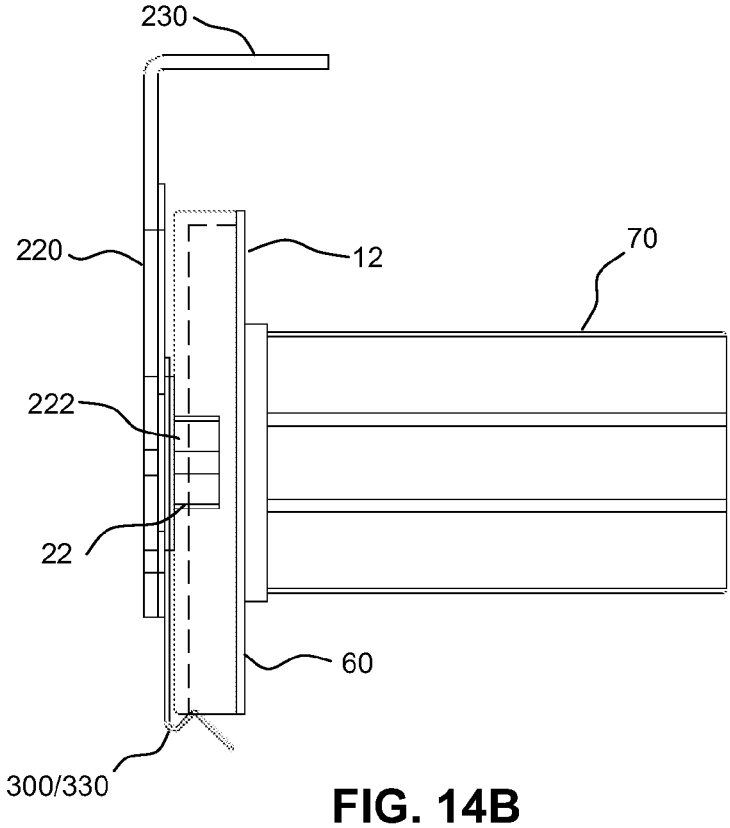

Referring to FIGS. 14A-B, according to an exemplary embodiment, the locking device 300 includes a snap clip 330 at the lower end of the attachment member 220. After the insert 222 of the bracket 200 is inserted into the socket 22 of the clutch 10, the lower end of the clutch 10 is pushed into place against the bracket 200 so that the snap clip 330 latches over the lower end of the clutch 10. The snap 330 may also engage with a recess (not shown) at the lower end of the clutch 10. The snap clip 330, and the connection between the insert 222 and socket 22, act to secure the clutch 10 to the bracket 200.

Figure 15A:
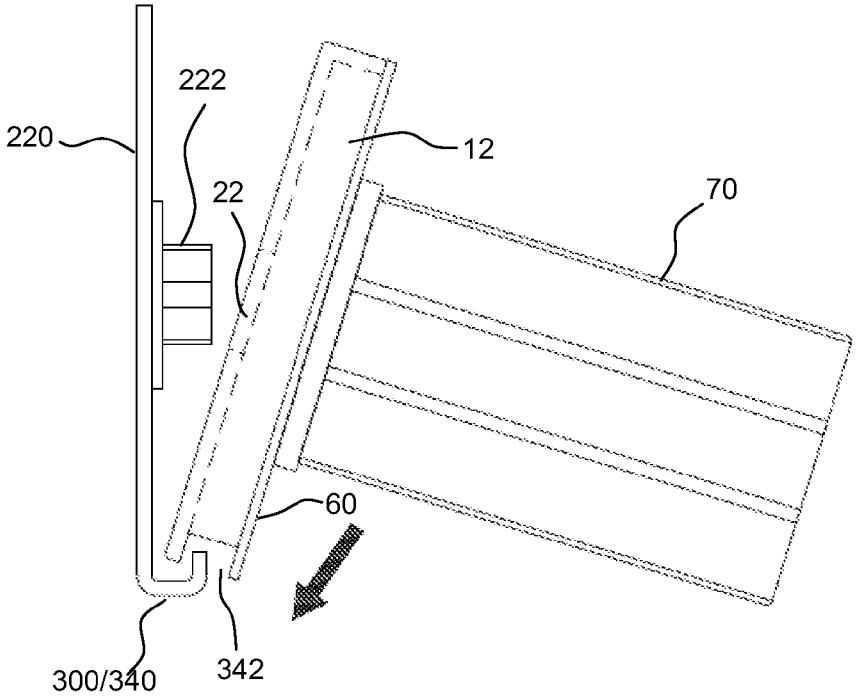
FIGS. 15A-B are side views of a roller shade clutch assembly illustrating a locking device according to another exemplary embodiment.
Figure 15B:
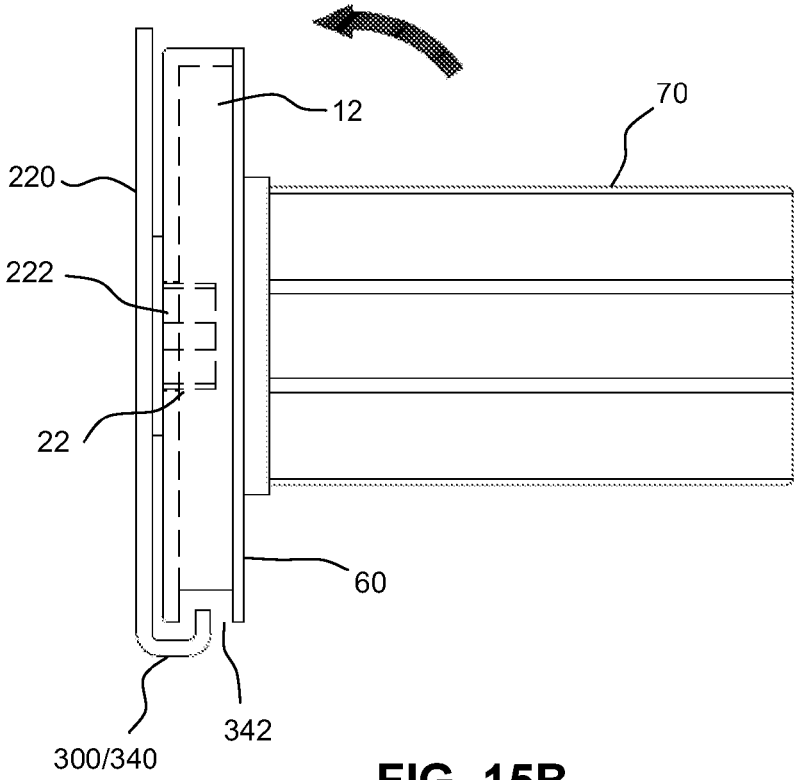

Referring to FIG. 15A-B, according to an exemplary embodiment, the locking device 300 includes one or more hook-type members 340 at the lower end of the attachment member 220 of bracket 200. Each hook-type members 340 is inserted into a recess 342 formed at the lower end of the clutch 10. The upper end of the clutch 10 is then pushed into place against the bracket 200 so that the insert 222 of the bracket 200 is inserted into the socket 22 of the clutch 10. The hook-type member 340, and the connection between the insert 222 and socket 22, act to secure the clutch 10 to the bracket 200.

Figure 16A:
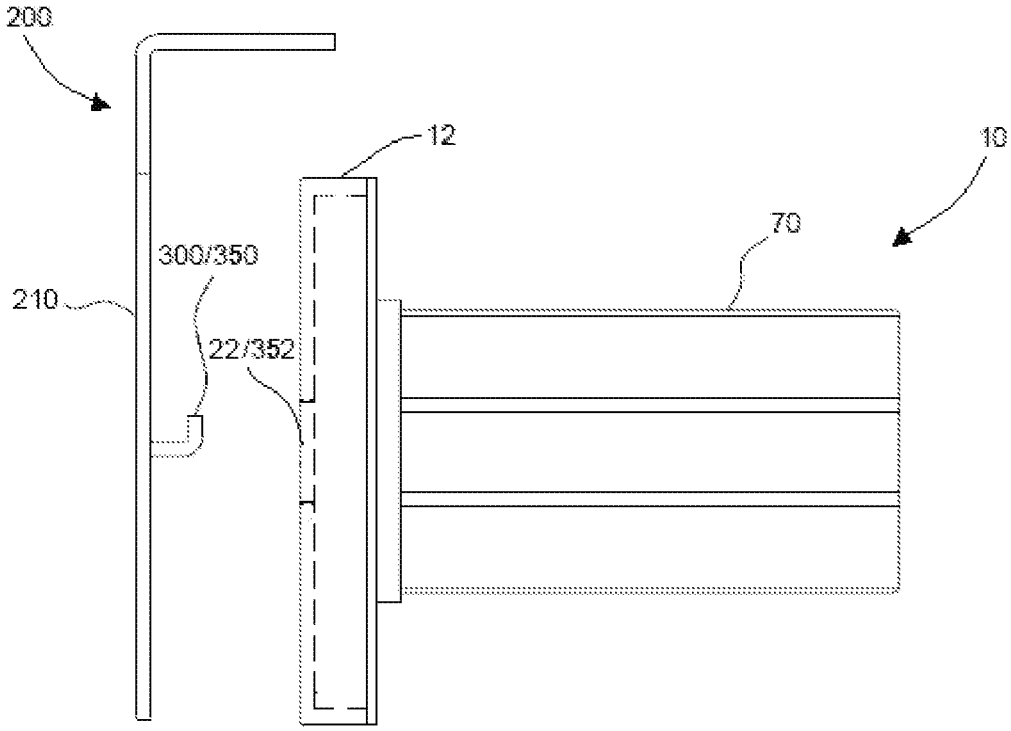
FIGS. 16A-B are side views of a roller shade clutch assembly illustrating a locking device according to another exemplary embodiment.
Figure 16B:
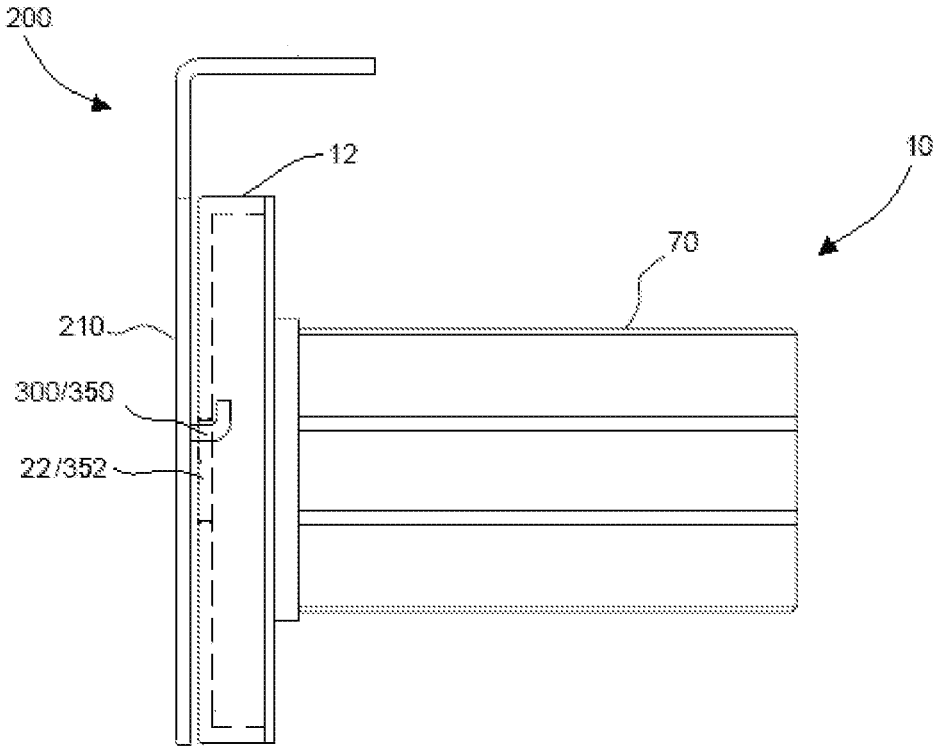

Referring to FIGS. 16A-B, according to an exemplary embodiment, the locking device 300 includes one or more hook-type members 350 at locations on the forward clutch-facing surface of the mounting plate 210 of bracket 200. The clutch 10 may include one or more corresponding recesses 352 in the rear facing surface into which the hook-type members 350 are inserted. The clutch 10 may then be pushed into place against the bracket 200, and the connections between the hook-type members 350 and the recesses 352 may act to secure the clutch 10 to the bracket 200. For example, if there are more than one hook-type members 350, there may be a corresponding number of recesses 352 formed in the rear facing surface of the clutch 10 into which hook-type members 350 are inserted. If there is one hook-type member, the hook-type member 350 may inserted into a recess 352 formed in connection with the socket 22.

Figure 17A:
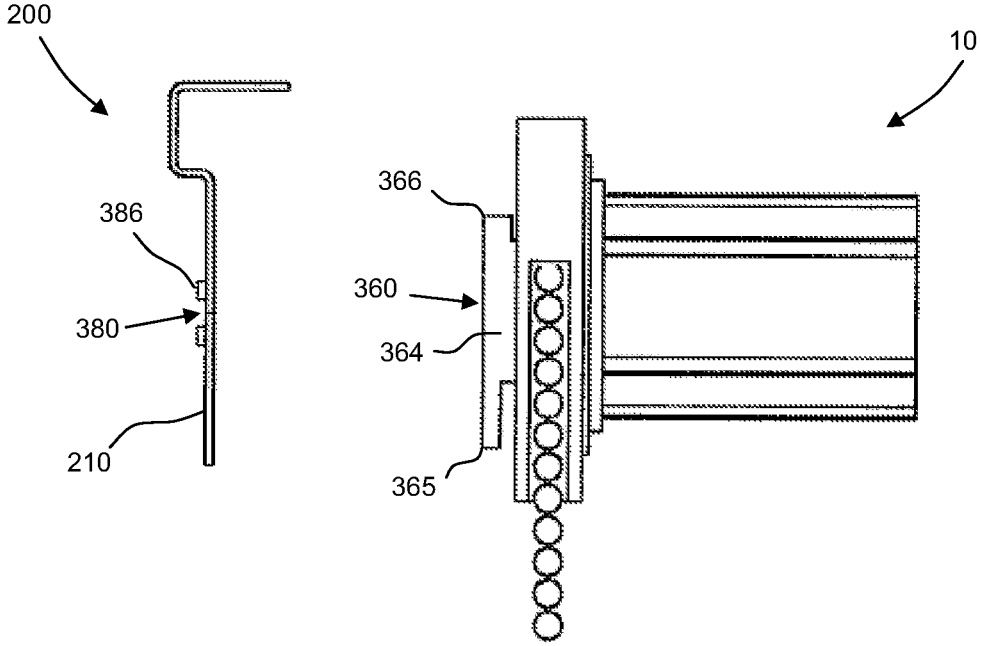
FIGS. 17A-B are side views of a roller shade clutch assembly illustrating a locking device according to another exemplary embodiment.
Figure 17B:
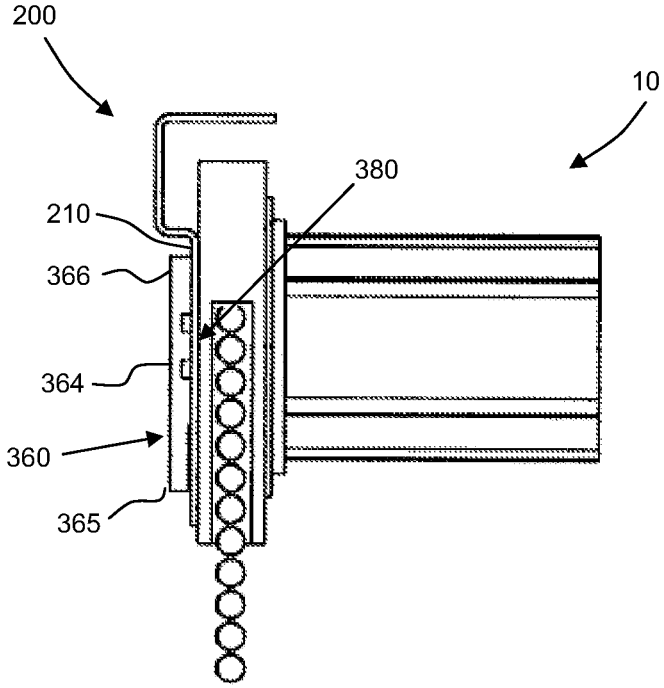
Figure 18A:
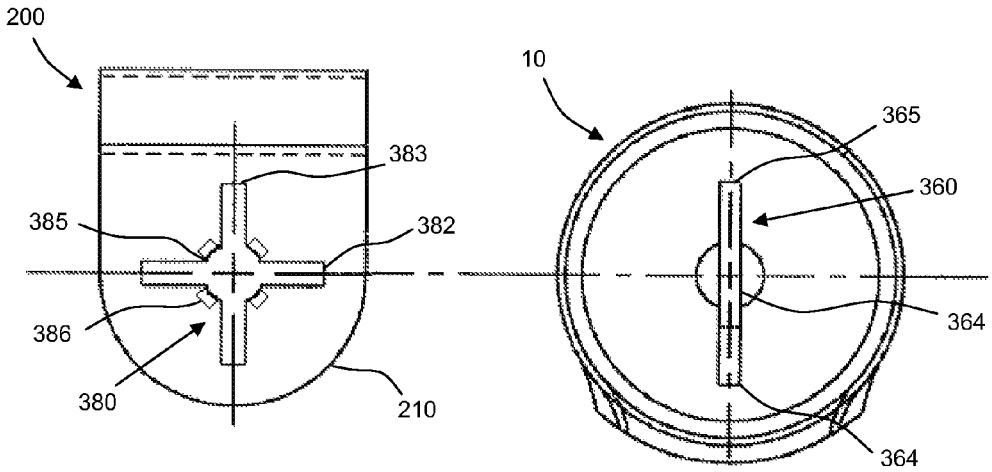
FIG. 18-C are front views of the he locking device of FIGS. 17A-B.
Figure 18B:
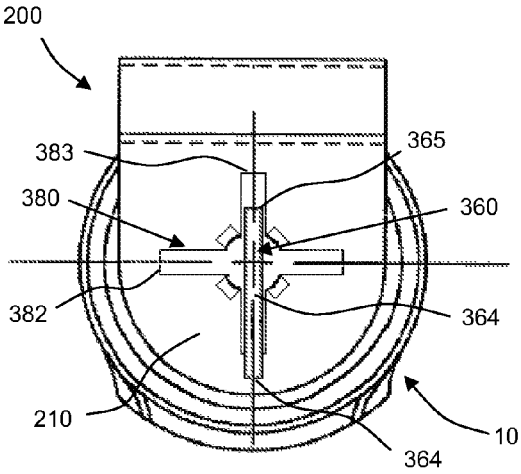

Referring to FIGS. 17-19, according various exemplary embodiments, the locking device 300 comprises an insert 360 for securing the clutch 10 to the mounting plate of the bracket 200. The insert 360 includes a body portion 362 which may be inserted within a socket 22 in the rear facing surface of the clutch 10 and a head portion 364 that remains at least partly extended beyond the rear facing surface of the clutch 10. The head portion 364 of the insert 360 may be engaged with a slot 380 formed in the bracket 200 to create a secure connection between the clutch 10 and the bracket 200.

The head portion 364 of the insert 360 may include first and second arms 365 and 366 that extend transversely outward from the body portion 362 in opposite directions. Together the first and second arms 365 and 366 extend a distance from end-to-end that is less than or approximately equal to the length of the slot 380. In an embodiment such as the one shown, the first arm 365 extends a distance greater than the second arm 366, however in other embodiments the first and second arms 365 and 366 may be the same length. The first arm 365 may have a depth less than the second arm 366, such that after the inset 360 is inserted into the clutch 10, the underside surface of the second arm 366 abuts the rear facing surface of the clutch 10 while a recess 368 is formed between underside of the first arm 365 and the rear facing surface of the clutch 10.

Figure 18C:
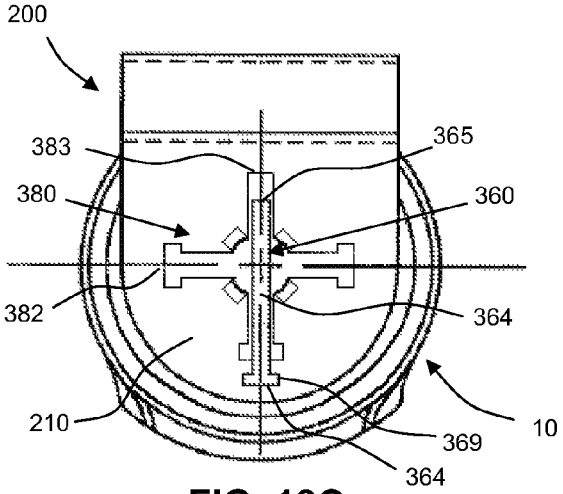

The bracket 200 may be secured to the clutch 10 by inserting the head portion 364 of the insert 360 through the slot 380 in the bracket 200, and sliding the bracket 200 upward in relation to the insert 306 such that the centerline of the insert 360 is off-center from the centerline of the bracket 200. The bracket 200 may be received in the recess 368 beneath the first arm 365 on one side of the insert 360 to secure the bracket 200 to the clutch 10. The first arm 365 may optionally include tabs 369 extending transversely from the sides which provide additional surface area for engagement between the insert 360 and the bracket 200 such as shown in FIG. 18C. The second arm 365 may act as a buttress at the opposite side of the insert 360 providing leverage to prevent the insert 306 from being pulled out of the socket 22.

The slot 380 in the bracket 200 may be a cross slot comprising a first slot 382 oriented vertically and a second slot 383 oriented horizontally. The arrangement of the first and second slots 382, 383 may allow the clutch 10 to be secured on the bracket 200 in positions corresponding to a side wall mount position or a top ceiling mount position. The slot 380 may include an enlarged, circular opening 385 at the intersection between the first and second slots 382, 383 which is sized to allow for universal use with various clutches and/or idlers. A plurality of prongs 376 may be located at the center of the first and second slots 382, 383 which extend normal to the surface of the mounting plate 210 of the bracket 200. The prongs 386 may provide additional stability for the insert 360 so that the head portion 364 of the insert 360 remains properly aligned and secured within the slot 380. The prongs 386 may also ensure that there is sufficient clearance for head portion 364 of the insert 360 between the rear surface of the bracket and the surface on which the bracket is to be mounted. However, it is noted that the prongs 386 are optional, and are not necessary for the locking device 300 to function as intended.

Figure 19A:
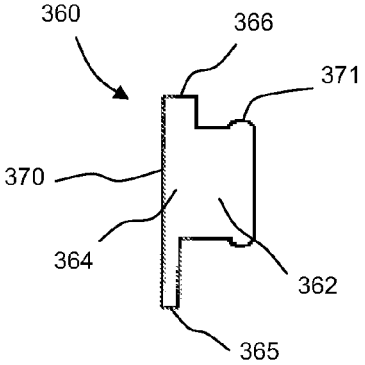
FIGS. 19A-C are side views of an insert of the locking device of FIGS. 17A-B according to various exemplary embodiments.
Figure 19B:
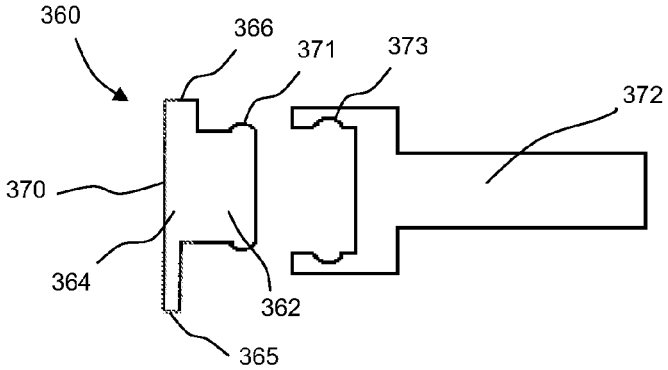
Figure 19C:
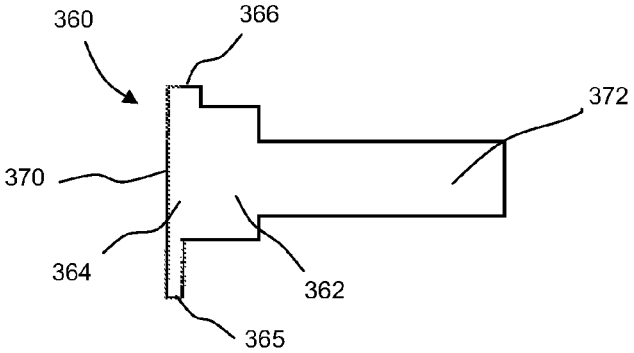

The insert 360 may be embodied a variety of forms, examples of which are illustrated in FIGS. 19A-19C. In an embodiment shown in FIG. 19A, the insert 360 may be a single insert member 370 which is inserted directly into the socket 22 of the clutch 10. The insert member 370 may include locking tabs 371 which engage with cooperating features formed within the socket 22 to secure the insert 360 in place. The insert 370 may also be secured in place with an adhesive. The insert member 370 may, for example, be comprised of metal, plastic, or the like and may be formed by a stamping process. In an embodiment shown in FIG. 19B, the insert 360 may include insert member 370 of FIG. 19A which is inserted into a post 372. The insert member 370 may include locking tabs 371 which engage with cooperating features 373 in the post 372 to secure insert member 370 within the post 372. The post 372 may extend through a hole formed in the post 20 of the clutch 10 and may be secured within the clutch 10 by a mechanical fastener 62, such as a screw, pin, rivet, or the like. The post 372 may, for example, be die cast from metal, plastic, or the like. The insert 360 of FIG. 19B may also be formed as an integral unit such as shown in FIG. 19C.

While the bracket 200 is described in conjunction with clutch 10, it is intended that clutch 10 can also be mounted to conventional bracket assemblies that are known in the art. Further, it is intended that bracket 200 can be mounted with conventional clutches that are known in the art.

Now that exemplary embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A roller shade mounting assembly comprising:

a roller shade clutch;

a bracket configured to be mounted directly to at least one of a wall, a ceiling, or a window frame; and a locking device for releasably coupling the clutch to the bracket, the locking device comprising an insert having a body portion, a first end that is configured to be secured within a recess formed in a rear facing surface of the clutch, and a second end that is configured to remain extending at least partially beyond the rear surface of the clutch and to be secured by engagement with a slot formed in the bracket;

wherein the second end of the insert comprises first and second arms extending transversely outward in opposite directions and one or more tabs extending transversely from sides of the first arm, the first and second arms and one or more tabs configured to extend completely through the bracket, and at least a portion of the bracket is adapted to be inserted into a recess defined by the first arm, the one or more tabs and the rear facing surface of the clutch.

2. The assembly of claim 1, wherein an edge of the slot in the bracket is slidably engaged within the recess formed in the second end of the insert to secure the bracket to the insert.

3. The assembly of claim 1, wherein the first arm is longer than the second arm.

4. The assembly of claim 1, wherein a centerline of the insert is off-center from a centerline of the bracket when the clutch is secured to the bracket.

5. The assembly of claim 1, wherein the first end of the insert includes one or more locking tabs for securing the insert within cooperating features formed in the recess formed in the rear facing surface of the clutch.

6. The assembly of claim 1, wherein the slot formed in the bracket is a cross slot including first and second slots oriented for attachment of the clutch to the bracket in positions corresponding to a side wall mount position and a top ceiling mount position.

7. The assembly of claim 6, wherein the first slot is oriented substantially horizontally and the second slot is oriented substantially vertically.

* * * * *